US007786066B2

(12) United States Patent
Malet et al.

(10) Patent No.: US 7,786,066 B2
(45) Date of Patent: Aug. 31, 2010

(54) STABILITY OF DETERGENTS CONTAINING HYPOCHLORITE, PHOSPHONATE CHELANT, AND OPTICAL BRIGHTENER

(75) Inventors: Carlos Malet, Sant Boi de Llobregat (ES); Mercedes Mendoza Cruz, Barcelona (ES); Miguel Osset, Sant Pere de Vilamajor (ES); Nuria Montaner, Barcelona (ES)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/147,405

(22) Filed: Jun. 26, 2008

(65) Prior Publication Data

US 2008/0305980 A1 Dec. 11, 2008

Related U.S. Application Data

(63) Continuation of application No. PCT/EP2006/011814, filed on Dec. 8, 2006.

(30) Foreign Application Priority Data

Dec. 30, 2005 (DE) ..... 10 2005 063 177

(51) Int. Cl.
*C11D 3/395* (2006.01)
*C11D 3/42* (2006.01)
*C11D 7/36* (2006.01)

(52) U.S. Cl. ..... 510/307; 510/276; 510/286; 510/288; 510/302; 510/340; 510/351; 510/367; 510/380; 510/394; 510/426; 510/427; 510/436; 510/490

(58) Field of Classification Search ..... 510/276, 510/286, 288, 302, 307, 340, 351, 367, 380, 510/394, 426, 427, 436, 490
See application file for complete search history.

(56) References Cited

U.S. PATENT DOCUMENTS

| | | | | |
|---|---|---|---|---|
| 3,393,153 | A | 7/1968 | Zimmerer et al. | |
| 3,655,566 | A | 4/1972 | Robinson et al. | |
| 3,666,680 | A | 5/1972 | Briggs | |
| 3,876,551 | A | 4/1975 | Laufer et al. | |
| 4,113,645 | A | 9/1978 | DeSimone | |
| 4,116,849 | A | 9/1978 | Leikhim | |
| 4,193,888 | A | 3/1980 | McHugh | |
| 4,411,799 | A | 10/1983 | Ito et al. | |
| 4,828,723 | A * | 5/1989 | Cao et al. | 510/304 |
| 4,830,782 | A * | 5/1989 | Broze et al. | 510/304 |
| 5,139,695 | A | 8/1992 | Eckhardt | |
| 5,180,514 | A | 1/1993 | Farr et al. | |
| 5,185,096 | A | 2/1993 | Ahmed | |
| 5,229,027 | A | 7/1993 | Ahmed | |
| 5,972,038 | A * | 10/1999 | Amestica et al. | 8/103 |
| 6,083,892 | A | 7/2000 | Severns et al. | |
| 6,090,770 | A | 7/2000 | Mendoza et al. | |
| 6,204,235 | B1 | 3/2001 | Jimenez et al. | |
| 6,448,215 | B1 | 9/2002 | Grande et al. | |
| 6,506,718 | B1 * | 1/2003 | Todini | 510/380 |
| 6,649,583 | B2 * | 11/2003 | Todini | 510/380 |
| 6,894,015 | B1 * | 5/2005 | Briatore et al. | 510/303 |
| 2003/0032565 | A1 | 2/2003 | Sivik | |
| 2004/0023837 | A1 | 2/2004 | Zanardi | |
| 2004/0192576 | A1 | 9/2004 | Schmid et al. | |

FOREIGN PATENT DOCUMENTS

| | | |
|---|---|---|
| DE | 2810187 | 9/1978 |
| DE | 3201460 | 8/1982 |
| DE | 4140830 | 6/1992 |
| DE | 19700799 | 7/1998 |
| DE | 19803054 | 7/1999 |
| DE | 19855329 | 6/2000 |
| DE | 102004020017 | 11/2005 |
| EP | 0079102 | 5/1983 |
| EP | 311175 | 4/1989 |
| EP | 0351947 | 1/1990 |
| EP | 439878 | 8/1991 |
| EP | 0462793 | 12/1991 |
| EP | 0565788 | 10/1993 |
| EP | 0606707 | 7/1994 |
| EP | 0622451 | 11/1994 |
| EP | 0812909 | 12/1997 |
| EP | 0867503 | 9/1998 |
| EP | 0903403 | 3/1999 |
| EP | 905223 | 3/1999 |
| EP | 0905225 | 3/1999 |
| EP | 931829 | 7/1999 |
| EP | 1001010 | 5/2000 |
| EP | 1348755 | 1/2003 |
| EP | 1391501 | 2/2004 |
| EP | 1462512 | 9/2004 |
| EP | 1462564 | 9/2004 |
| EP | 1614742 | 1/2006 |
| GB | 2271119 | 4/1994 |
| JP | 52069415 | 6/1977 |
| JP | 07233396 | 9/1995 |
| WO | WO9305136 | 3/1993 |
| WO | WO9407987 | 4/1994 |
| WO | WO9410280 | 5/1994 |
| WO | WO9706233 | 2/1997 |
| WO | WO9745523 | 12/1997 |
| WO | WO9915616 | 4/1999 |
| WO | WO9928427 | 6/1999 |
| WO | WO2004085590 | 10/2004 |
| WO | WO2004104157 | 12/2004 |
| WO | WO2006010089 | 1/2006 |
| WO | WO2006048104 | 5/2006 |

* cited by examiner

*Primary Examiner*—Charles I Boyer
(74) *Attorney, Agent, or Firm*—David P. LeCroy

(57) ABSTRACT

The stability of aqueous, liquid detergents containing hypochlorite and brighteners is achieved by the use of a specific complexing agent.

11 Claims, No Drawings

STABILITY OF DETERGENTS CONTAINING HYPOCHLORITE, PHOSPHONATE CHELANT, AND OPTICAL BRIGHTENER

CROSS-REFERENCE TO RELATED APPLICATIONS

This application is a continuation under 35 U.S.C. Section 365(c) and 35 U.S.C. Section 120 of International Application No. PCT/EP2006/011814, filed Dec. 8, 2006. This application also claims priority under 35 U.S.C. Section 119 of German Patent Application No. DE 10 2005 063177.0, filed Dec. 30, 2005. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention relates to the stabilization of hypochlorite-containing liquid laundry detergents which contain optical brighteners.

Sodium hypochlorite is known as a highly effective bleaching agent and has long been used, optionally together with soaps and/or synthetic surfactants, for removing stains and all kinds of soiling, not only when laundering textiles but also when cleaning hard surfaces. It is usually sold for household use in concentrations of approx. 2 wt. % to 10 wt. % in water.

Liquid laundry detergent preparations or corresponding preparations of cleaning agents for hard surfaces which contain hypochlorite as bleaching component are susceptible, when stored for an extended period, to suffering a loss in activity, in particular, due to the hypochlorite degradation which occurs in such cases. Constituents which are desired in laundry detergents and cleaning agents from an applicational standpoint or for aesthetic reasons also include, in addition to the active ingredients which decisively influence performance, among which hypochlorite may, in particular, be mentioned, those active ingredients which tend more to have an impact on the optical appearance of the textiles treated therewith. These, in particular, include optical brighteners which become attached to the fibers of the textile material during the washing operation. These compounds are capable of absorbing light and emitting shorter wavelength light. The overall result of absorbing red and yellow colored light and emitting blue to ultraviolet light is an increase in the intensity of light perceived as white, such that a textile treated in this manner appears optically brighter. For white laundry, this is a very desirable effect; laundry detergents which are intended to be used for washing colored textiles generally contain no optical brighteners. Optical brighteners are highly susceptible to oxidative attack by hypochlorite, which means that, after storage, corresponding agents containing both of these components, in addition to the consequent loss of bleaching agent, also exhibit the disadvantage that the active ingredient of the optical brightener which is jointly responsible for the optical impression of whiteness is no longer available, or at least not in its entirety.

(2) Description of Related Art, Including Information Disclosed Under 37 C.F.R. Sections 1.97 and 1.98

International Patent Application WO 99/15616 proposes adding free-radical scavengers to hypohalite-containing bleaching agents which contain optical brighteners in order to stabilize the optical brighteners.

BRIEF SUMMARY OF THE INVENTION

It has surprisingly now been found that certain compounds, which are not free-radical scavengers, make a highly effective contribution to stabilizing optical brighteners in hypochlorite-containing liquids.

The present invention provides the use of diethylenetriaminepentamethylene-phosphonic acid and/or the alkali metal salt thereof for stabilizing optical brighteners in aqueous liquid laundry detergents which contain alkali metal hypochlorite.

It has surprisingly now been found that when diethylenetriaminepentamethylene-phosphonic acid and/or the alkali metal salts thereof are added to hypochlorite-containing liquid agents, the stability of optical brighteners contained in these agents is increased and also the hypochlorite is less rapidly degraded during storage than is the case without said addition.

The present invention secondly provides an aqueous liquid bleaching agent or bleaching laundry detergent containing alkali metal hypochlorite and optical brightener, which is characterized in that it additionally contains diethylenetriaminepentamethylenephosphonic acid and/or the alkali metal salt thereof.

BRIEF DESCRIPTION OF THE SEVERAL VIEWS OF THE DRAWING(S)

Not Applicable

DETAILED DESCRIPTION OF THE INVENTION

It is normally sufficient for the liquid agent to be stabilized to contain more than 0 wt. % up to approx. 1 wt. %, in particular approx. 0.01 wt. % to approx. 0.5 wt. % of diethylenetriamine-pentamethylenephosphonic acid and/or the alkali metal salt thereof. Diethylenetriaminepentamethylenephosphonic acid is commercially obtainable, for example, under the trade name Dequest® 2066.

The agent according to the invention may contain any desired alkali metal salts of diethylenetriaminepentamethylenephosphonic acid. It is preferred to use the mono-, di-, tri-, tetra- or penta-sodium salt, which may be introduced as such in the course of producing agents according to the invention or is formed in situ from the free diethylenetriaminepentamethylene-phosphonic acid which is introduced instead, and alkali metal.

The optical brightener stabilized according to the invention is preferably selected from a compound according to one of the following formulae (I) to (VIII) or mixtures thereof, it being possible for those compounds shown with a C═C double bond in trans configuration also to be present at least in part with said bond in cis configuration:

(I)

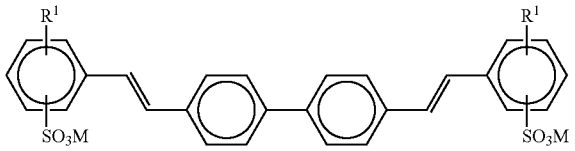

(II)

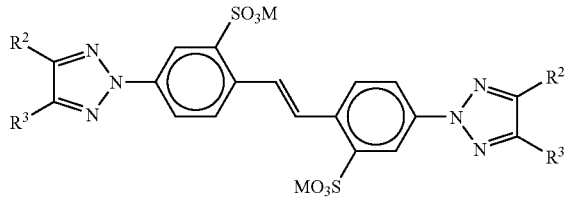

(III)

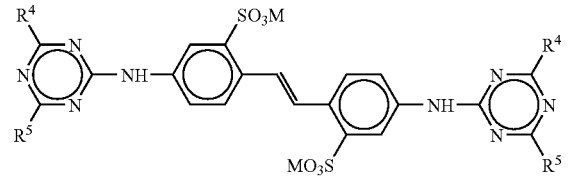

(IV)

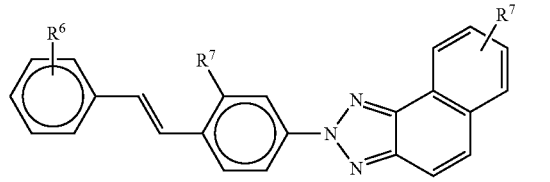

(V)

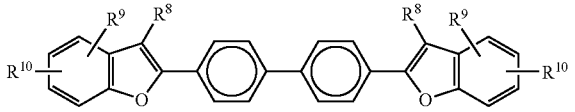

(VI)

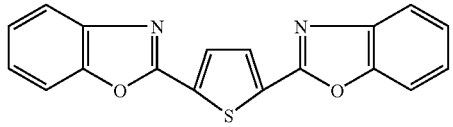

(VII)

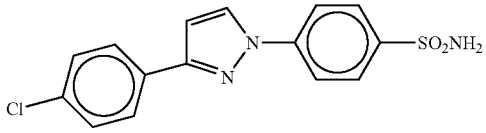

(VIII)

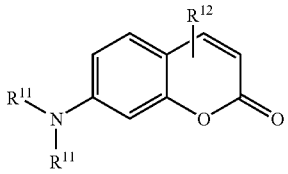

In these formulae $R^1$ means hydrogen, —$SO_3M$, —$OR^{13}$, —CN, —Cl, —$COOR^{13}$, —$CON(R^{13})_2$ $R^2$ and $R^3$ mutually independently mean hydrogen, —$R^{13}$ or —Ar, $R^4$ and $R^5$ mutually independently mean —OH, —Cl, —$NH_2$, —$OR^{13}$, —O—Ar, —$NHR^{13}$, —$N(R^{13})_2$, —$NR^{13}R^{14}$, —$N(R^{14})_2$, —NH—Ar, a morpholino group, —S—$R^{13}$ or —S—Ar, $R^6$ means hydrogen, —Cl or —$SO_3M$, $R^7$ means —CN, —$SO_3M$, —S—$R^{13}$ or —S—Ar, $R^8$ means hydrogen, —$R^{13}$, —Cl or —$SO_3M$, $R^9$ and $R^{10}$ mutually independently mean hydrogen, —$R^{13}$, —Cl, —$SO_3M$ or —$OR^{13}$, $R^{11}$ means hydrogen or —$R^{13}$, $R^{12}$ means hydrogen, —$R^{13}$, —CN, Cl, —$COOR^{13}$, —$CON(R^{13})_2$, —Ar or —O—Ar, $R^{13}$ means a branched or unbranched $C_1$ to $C_4$ alkyl group $R^{14}$ means a branched or unbranched $C_1$ to $C_4$ hydroxyalkyl group, Ar means a phenyl, naphthyl, pyrindinyl, pyridazinyl, pyrimidinyl, pyrazinyl, triazinyl, indolyl, anthracenyl, phenanthrenyl or benzonaphthyl group optionally substituted with —$R^{13}$, —Cl, —$SO_3M$ or —$OR^{13}$, M means hydrogen, Na, K, Ca, Mg, ammonium, mono-, di-, tri- or tetra-$R^{13}$-substituted ammonium, mono-, di-, tri- or tetra-$R^{14}$-substituted ammonium or ammonium mono-, di-, tri- or tetra-substituted with a mixture of $R^{13}$ and $R^{14}$.

Optical brighteners which correspond to the formulae (I) or (II) are particularly preferably used. For example, the compound according to formula (I) with $R^1$=M=H is obtainable under the name Tinopal® CBS-X from Ciba-Geigy and the compound according to formula (II) with $R^2$=M=H, $R^3$=phenyl is obtainable under the name Optiblanc® BRB from 3V Sigma. Laundry detergents or bleaching agents conventionally contain only small quantities of optical brighteners, for example from 10 ppm to 0.5 wt. %.

Preparations according to the invention are, in particular, suitable and highly effective as a bleaching agent or bleaching laundry detergent for white textiles. An agent according to the invention is active against a plurality of stains, including fatty soiling such as sebum, makeup or lipstick, enzymatically removable soiling such as blood, grass or cocoa, and bleachable soiling such as wine, coffee or tea, even after the composition has aged, i.e., if it has been stored for an extended period after manufacture.

A further advantage of bleaching agents according to the present invention is that they are suitable for bleaching textiles made from various materials, including those made from natural fibers such as cotton or linen, as well as those made from synthetic material, such as synthetic polymer fibers, and also those made from corresponding blend fabrics.

A liquid agent according to the present invention is advantageously applied onto the textiles to be cleaned in diluted form, for example, if it is used as a washing additive in hand or machine washing of textiles, or alone as a laundry detergent, but it may additionally or alternatively also be applied undiluted onto the textile, for example, as a liquid pretreatment agent or stain remover.

A bleaching agent in the form of hypochlorite is an essential constituent of the agents according to the invention. Bleaching agents per se are entirely known components of laundry detergent and cleaning agent compositions and are, in particular, also successful in combating mildew and mold and in disinfection. Although other alkali metal hypochlorites, such as, for example, potassium hypochlorite, are usable, it is nevertheless preferred to use sodium hypochlorite in agents stabilized according to the invention. Conventional commercial aqueous sodium hypochlorite solutions often contain considerable quantities of chloride salts. These may straightforwardly be used for producing agents according to the invention, such that it is not necessarily essential to use high purity NaOCl. In a preferred embodiment of the invention, the agents contain 0.5 wt. % to 5 wt. %, in particular, 1 wt. % to 4 wt. %, of alkali metal hypochlorite.

The agents stabilized according to the invention are usually alkaline and may for this purpose contain approx. 0.1 wt. % to 2 wt. %, in particular, 0.1 wt. % to 1.1 wt. %, of alkali metal hydroxide. The preferred alkali metal hydroxide is sodium hydroxide and the alkali metal salts which are mentioned in connection with the other constituents of the agent are likewise preferably sodium salts.

The preparations may contain surfactants which are stable in the presence of hypochlorite. Betaines are preferred, in particular those of the general formula IX,

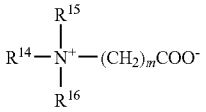

(IX)

in which $R^{14}$ is an alkyl or alkenyl group having 6 to 22 carbon atoms or a group $R^{17}CO—NH—(CH_2)_n—$, $R^{15}$ is hydrogen or an alkyl group having 1 to 4 carbon atoms, $R^{16}$ is hydrogen or an alkyl group having 1 to 4 carbon atoms, $R^{17}$ is an alkyl or alkenyl group having 6 to 22 carbon atoms, m is a number from 1 to 6 and n is a number from 1 to 3. Examples of particularly suitable representatives of this class of surfactants include $C_{12-18}$-alkyldimethylbetaine, commercially obtainable as coconut betaine, and $C_{10-16}$-alkyldimethylbetaine, commercially obtainable as lauryl betaine. A further class of particularly preferred surfactants are alkyl ether sulfates, which are obtainable by reacting alcohols (preferably having 6 to 22 carbon atoms) with alkylene oxides, in particular, ethylene oxide, and subsequent sulfation and neutralization, in particular, a $C_{12-14}$ fatty alcohol ether sulfate alkoxylated with 2 equivalents of ethylene oxide. The corresponding cation in the ether sulfates is preferably sodium. Surfactants are preferably present in agents stabilized according to the invention in quantities of up to 20 wt. %, in particular, of 0.1 wt. % to 15 wt. %.

In addition to the diethylenetriaminepentamethylenephosphonic acid and/or the alkali metal salt thereof, the preparations may optionally contain further sequestrants, preferably alkylphosphonic acids having at least one amine oxide substituent on the alkyl group, here designated amine oxide phosphonic acids, polyacrylic acids and/or polyacrylic acids comprising phosphono groups, which may also be present in the form of the alkali metal salts thereof. Incorporating such complexing agents surprisingly gives rise to particularly good stability of the hypochlorite. Amine oxide phosphonic acids are usually produced by oxidation of aminoalkylphosphonic acids. They preferably belong to the group of compounds of the general formula (X),

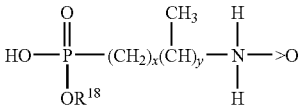

(X)

in which $R^{13}$ is hydrogen, a $—(CH_2)_x(CHCH_3)_y—NH_2$->O group or an alkali metal, x is a number from 1 to 4 and y is 0 or 1. The amine oxide based on aminotrimethylenephosphonic acid is among the particularly preferred amine oxide phosphonic acids. Such additional sequestrants are preferably present in an amount of 0.01 wt. % to 2 wt. %.

In addition to the stated constituents, the preparations stabilized according to the invention may contain small quantities of pH-buffering substances and/or one or more bleach-stable dyes or odoriferous substances. The optionally present fragrance component is preferably of a higher relative volatility than the constituents which are responsible for any bleach odor. The agents preferably contain more than 0 wt. % to approx. 0.01 wt. %, in particular, approx. 0.001 wt. % to approx. 0.008 wt. % of a colored, in particular, blue and/or green, metal pigment. Among these, complex compounds of nickel, cobalt, copper, iron and/or manganese are preferred; copper phthalocyanine dyes are particularly preferred. The stability both of the colored metal pigment and also of the alkali metal hypochlorite is increased by the presence of alkali metal iodide. Therefore, agents according to the invention preferably contain more than 0 wt. % up to approx. 0.01 wt. %, in particular approx. 0.001 wt. % to approx. 0.006 wt. % of alkali metal iodide, in particular potassium iodide. Usable pH-buffering constituents are preferably selected from among carbonates, polycarbonates, sesquicarbonates, silicates, polysilicates, borates, phosphates, stannates, aluminates of alkali metals and mixtures of these, with preferred alkali metals being sodium and potassium. Starting materials for producing, for example, the hypohalite bleaching agent may contain secondary products, for example, carbonate, which may give rise to a content of such secondary products of optionally up to 0.4 wt. % in agents according to the invention.

The aqueous compositions according to the invention usually have viscosities in the range from approx. 25 mPa·s to 1500 mPa·s, in particular, from 50 mPa·s to 1100 mPa·s.

A composition according to the invention may, in diluted or undiluted form, be used for removing soiling and stains from textiles by bringing the composition and the textile into contact with one another for a period which is sufficient for bleaching of the textile, and thereafter rinsing the textile with water. Alternatively thereto or alternatively to rinsing with water, the textile may also be washed using an agent according to the invention by hand or in machine washing process in which an agent according to the invention is dispensed into a conventional washing machine.

EXAMPLE

In an aqueous composition containing 1.43 mmol/l of NaOCl, $8.10^{-4}$ mmol/l of Tinopal® CBS-X and 0.36 mmol/l of Dequest® 2066, the decrease in fluorescence of the optical brightener after storage for 1 hour amounted to 16%, whereas it amounted to 94% in an otherwise identical composition which did not contain the diethylenetriaminepentamethylene-phosphonic acid and was stored under identical conditions.

If the stated optical brightener was replaced with $1.5\cdot10^{-4}$ mmol/l of Hostalux® PCNX, the decreases amounted to 16% and 71%.

If the stated optical brightener was replaced with $7.5\cdot10^{-4}$ mmol/l of Optiblanc® BRB and 0.018 mmol/l of Fe was additionally added to the solutions, the decreases amounted to 4% and 97%.

The invention claimed is:

1. An aqueous laundry detergent comprising:

a) diethylenetriaminepentamethylenephosphonic acid and/or the alkali metal salt thereof;

b) an optical brightener of the formula:

(I)

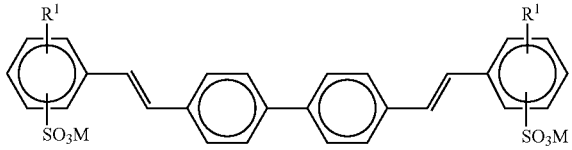

wherein R1 and M are hydrogen;

c) an alkali metal hypochlorite; and d) a surfactant system comprising up to 20 wt. % of bleach-stable surfactant mixture comprising a betaine and an alkyl ether sulfate;

wherein the diethylenetriaminepentamethylenephosphonic acid and/or its alkali metal salt are not free-radical scavengers, the stability of the optical brightener according to formula (I) in the laundry detergent is greater than comparable detergents without the diethylenetriaminepentamethylenephosphonic acid and/or its alkali metal salt, and wherein the hypochlorite degrades more slowly during storage of the laundry detergent versus comparable detergents without the diethylenetriaminepentamethylenephosphonic acid and/or its alkali metal salt.

2. The composition of claim 1 wherein the alkali metal salt is a sodium salt.

3. The composition of claim 1 wherein the composition contains from 0.01 wt. % to 1.0 wt. % of diethylenetriaminepentamethylenephosphonic acid and/or the alkali metal salt thereof.

4. The composition of claim 1 wherein the amount of the diethylenetriaminepentamethylenephosphonic acid and/or the alkali metal salt thereof is from 0.01 wt. % to 0.5 wt. %.

5. The composition of claim 1 further comprising an additional optical brightener selected from the group consisting of a compound of the formulae (I) to (VIII) or mixtures thereof (I)

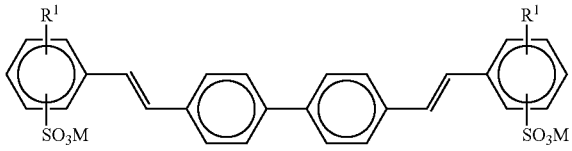

(II)

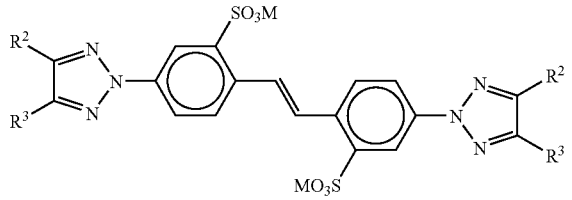

(III)

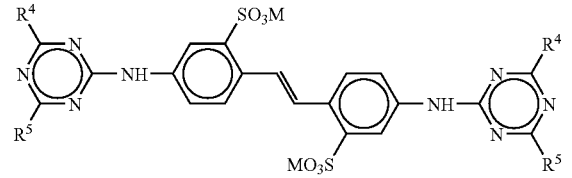

-continued (IV)

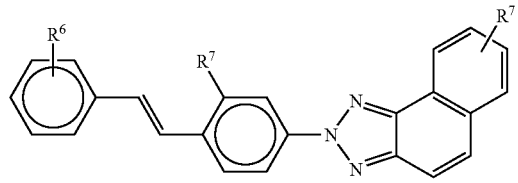

(V)

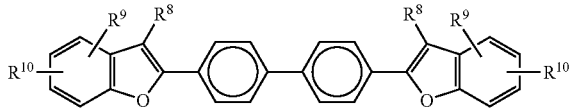

(VI)

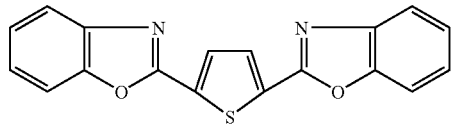

(VII)

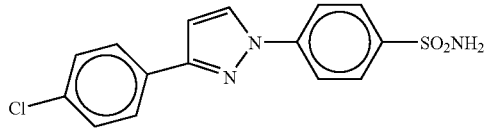

(VIII)

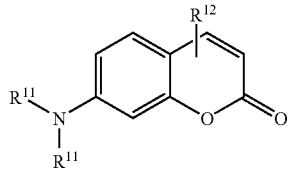

wherein $R^1$ is —$SO_3M$, —$OR^{13}$, —CN, —Cl, —$COOR^{13}$, —$CON(R^{13})_2$; each of $R^2$ and $R^3$ is independently hydrogen, $R^{13}$ or Ar; each of $R^4$ and $R^5$ is independently —OH, —Cl, —$NH_2$, —$OR^{13}$, —O—Ar, —$NHR^{13}$, —$N(R^{13})_2$, —$NR^{13}R^{14}$, —$N(R^{14})_2$, —NH—Ar, a morpholino group, —S—$R^{13}$ or —S—Ar; $R^6$ is hydrogen, —Cl or —$SO_3M$, $R^7$ is —CN, —$SO_3M$, —S—$R^{13}$ or —S—Ar; $R^3$ is hydrogen, —$R^{13}$, —Cl or —$SO_3M$; each of $R^9$ and $R^{10}$ is independently hydrogen, —$R^{13}$, —Cl, —$SO_3M$ or —$OR^{13}$; $R^{11}$ is hydrogen or —$R^{13}$; is hydrogen, —$R^{13}$—CN, Cl, —$COOR^{13}$, —$CON(R^{13})_2$, —Ar or —O—Ar; $R^{13}$ is a branched or unbranched $C_1$ to $C_4$ alkyl group; $R^{14}$ is a branched or unbranched $C_1$ to $C_4$ hydroxyalkyl group; Ar is a phenyl, naphthyl, pyrindinyl, pyridazinyl, pyrimidinyl, pyrazinyl, triazinyl, indolyl, anthracenyl, phenanthrenyl or benzonaphthyl group optionally substituted with —$R^{13}$, —Cl, —$SO_3M$ or —$OR^{13}$; M means hydrogen, Na, K, Ca, Mg, ammonium, mono-, di-, tri- or tetra-$R^{13}$-substituted ammonium, mono-, di-, tri- or tetra-$R^{14}$-substituted ammonium or ammonium mono-, di-, tri- or tetra-substituted with a mixture of $R^{13}$ and $R^{14}$.

6. The composition of claim 1 wherein the amount of alkali metal hypochlorite is from 0.5 wt. % to 5 wt. %.

7. The composition of claim 1 wherein the alkali metal hypochlorite is sodium hypochlorite.

8. The composition of claim 1 wherein the amount of the optical brightener is from 10 ppm to 0.5 wt. %.

9. A method for stabilizing an optical brightener in an aqueous liquid laundry detergent comprising:

adding less than about 1.0 wt. % of a) diethylenetriaminepentamethylenephosphonic acid and/or the alkali metal salt thereof to the aqueous liquid laundry detergent, which further comprises;

b) an optical brightener of the formula:

(I)

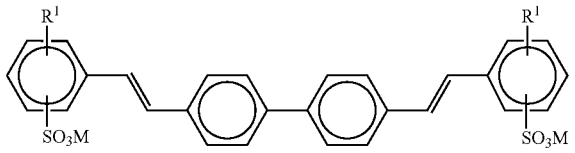

wherein $R^1$ and M are hydrogen;

c) an alkali metal hypochlorite; and d) a surfactant system comprising up to 20 wt. % of bleach-stable surfactant mixture comprising a betaine and an alkyl ether sulfate;

wherein the diethylenetriaminepentamethylenephosphonic acid and/or its alkali metal salt are not free-radical scavengers, the stability of the optical brightener according to formula (I) in the laundry detergent is greater than comparable detergents without the diethylenetriaminepentamethylenephosphonic acid and/or its alkali metal salt, and wherein the hypochlorite degrades more slowly during storage of the laundry detergent versus comparable detergents without the diethylenetriaminepentamethylenephosphonic acid and/or its alkali metal salt.

10. The method of claim 9 further comprising an additional optical brightener selected from the group consisting of a compound of the formulae (I) to (VIII) or mixtures thereof (I)

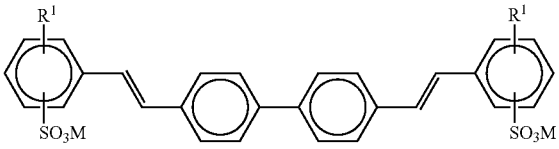

(II)

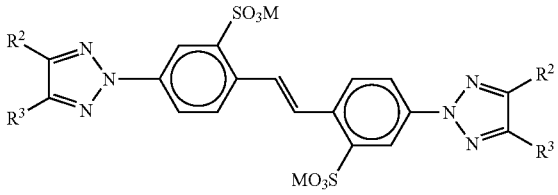

(III)

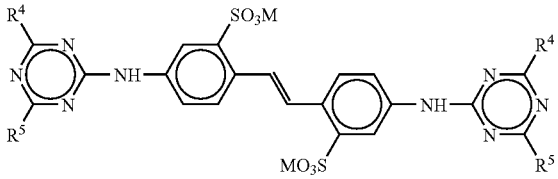

-continued (IV)

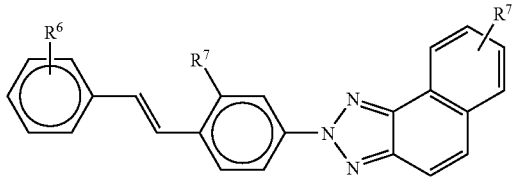

(V)

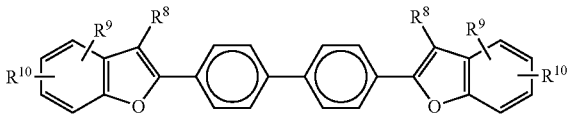

(VI)

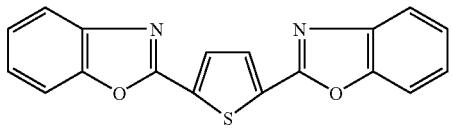

(VII)

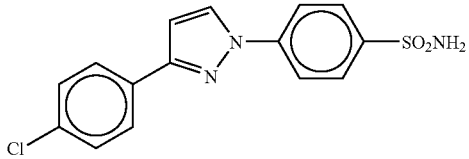

(VIII)

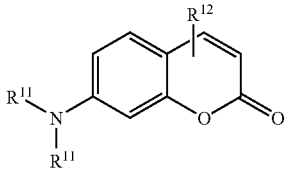

wherein $R^1$ is —$SO_3M$, —$OR^{13}$, —CN, —Cl, —$COOR^{13}$, —$CON(R^{13})_2$; each of $R^2$ and $R^3$ is independently hydrogen, $R^{13}$ or Ar; each of $R^4$ and $R^5$ is independently —OH, —Cl, —$NH_2$, —$OR^{13}$, —O—Ar, —$NHR^{13}$, —$N(R^{13})_2$, —$NR^{13}R^{14}$, —$N(R^{14})_2$, —NH—Ar, a morpholino group, —S—$R^{13}$ or —S—Ar; $R^6$ is hydrogen, —Cl or $SO_3M$, $R^7$ is —CN, —$SO_3M$, —S—$R^{13}$ or —S—Ar; $R^8$ is hydrogen, —$R^{13}$, —Cl or —$SO_3M$; each of $R^9$ and $R^{10}$ is independently hydrogen, —$R^{13}$, —Cl, —$SO_3M$ or —$OR^{13}$; $R^{11}$ is hydrogen or —$R^{13}$; —Cl, —$SO_3M$ or —$OR^{13}$; $R^{11}$ is hydrogen or —$R^{13}$; $R^{12}$ is hydrogen, —$R^{13}$—CN, Cl, —$COOR^{13}$, —$CON(R^{13})_2$, —Ar or —O—Ar; $R^{13}$ is a branched or unbranched $C_1$ to $C_4$ alkyl group; $R^{14}$ is a branched or unbranched $C_1$ to $C_4$ hydroxyalkyl group; Ar is a phenyl, naphthyl, pyrindinyl, pyridazinyl, pyrimidinyl, pyrazinyl, triazinyl, indolyl, anthracenyl, phenanthrenyl or benzonaphthyl group optionally substituted with —$R^{13}$, —Cl, $SO_3M$ or —$OR^{13}$; M means hydrogen, Na, K, Ca, Mg, ammonium, mono-, di-, tri- or tetra-$R^{13}$-substituted ammonium, mono-, di-, tri- or tetra-$R^{14}$-substituted ammonium or ammonium mono-, di-, tri- or tetra-substituted with a mixture of $R^{13}$ and $R^{14}$.

11. The method of claim 1 wherein the amount of the optical brightener is from 10 ppm to 0.5 wt. %.

* * * * *